US005561986A

United States Patent [19]

Goodall

[11] Patent Number: 5,561,986

[45] Date of Patent: Oct. 8, 1996

[54] PORTABLE CHILLING UNIT

[75] Inventor: Peter F. Goodall, Forest Row, England

[73] Assignee: The BOC Group plc, Surrey, England

[21] Appl. No.: 452,629

[22] Filed: May 25, 1995

[30] Foreign Application Priority Data

Jun. 15, 1994 [GB] England ..... 9411942

[51] Int. Cl.[6] ..... F25D 17/04

[52] U.S. Cl. ..... 62/406; 62/299; 62/434

[58] Field of Search ..... 62/406, 434, 299

[56] References Cited

U.S. PATENT DOCUMENTS 895,962 8/1908 Chase ..... 62/406

2,585,360 2/1952 Willaims ..... 62/299

2,875,595 3/1959 Kleist ..... 62/406

3,228,205 1/1966 Franklin ..... 62/406

*Primary Examiner*—Ronald C. Capossela

*Attorney, Agent, or Firm*—R. Hain Swope; David A. Draegert

[57] ABSTRACT

A portable chilling unit for chilling either the whole or a selected portion of the interior of a container comprises a plurality of eutectic elements adapted for pre-chilling by exposure to liquid cryogen, a height adjustable inlet and an outlet towards the base of the unit. An insulating blanket is attachable to the inlet such that, in operation, the blanket may be placed over the cargo to be chilled and only atmosphere from under the blanket is drawn through the unit for chilling.

9 Claims, 2 Drawing Sheets

PORTABLE CHILLING UNIT

The present invention relates to a portable chilling unit and relates particularly, but not exclusively, to such units for use in refrigerating the interior of cargo containers so as to maintain chilled food-stuffs and/or other materials disposed therein below a predetermined temperature.

BACKGROUND OF THE INVENTION

Presently known mechanical chilling devices for cargo containers are usually fixed to and pass through the front bulkhead of such containers, road vehicles or railway wagon bodies. Such chilling devices are driven either by an internal combustion engine forming part of the device, or by an electric motor supplied with current generated by, e.g. the engine of a road vehicle or an axle mounted generator in railway equipment. With containers, road vehicles and wagons employing eutectic beams or plates for cooling purposes the plates or beams are usually mounted on the inside of the walls or roof of the container. Eutectic beams are frozen to operational temperatures by either an externally mounted refrigeration compressor, driven by an internal combustion engine, or by an external source of electric power which is disconnected when freezing is complete and the container or vehicle is about to enter service. In either instance, the vehicle mounted equipment occupies valuable cargo space especially when the container or vehicle is to be used for the carriage of goods not requiring a controlled atmosphere. In addition, such equipment tends to cool the entire atmosphere within the cargo compartment rather than just that surrounding the goods requiring refrigeration. In accordance with the present invention, there is provided a portable chilling unit which substantially reduces the problems associated with the above-mentioned devices.

SUMMARY OF THE INVENTION

The present invention comprises a portable chilling unit positionable within a container and for chilling the interior or a portion thereof, said unit comprising a thermally insulated compartment having a chilling means positioned therein and having an inlet for receiving atmosphere from the interior of the container, drawing means for drawing atmosphere into the compartment and expelling said atmosphere from the compartment through an outlet positioned below said inlet, said chilling means comprising a plurality of eutectic elements adapted for pre-chilling by exposure to the chilling effect of liquid cryogen.

DETAILED DESCRIPTION OF THE PREFERRED EMBODIMENTS

The portable chilling apparatus of the present invention comprises a thermally insulated compartment having a chilling means positioned therein, said chilling means having an inlet for receiving atmosphere from the interior of the container wherein the apparatus is positioned, drawing means for drawing atmosphere into and expelling it from the compartment through an outlet positioned below the inlet. The chilling means comprises a plurality of eutectic elements adapted for pre-chilling by exposure to the chilling effect of liquid cryogen.

Preferably, the unit further including an insulating blanket for placement over any cargo positioned within said container, said inlet being positionable immediately under said blanket for drawing atmosphere from thereunder. The unit includes securing means for securing an edge of the blanket to the inlet which, preferably, is height adjustable. The insulating blanket is utilized when the cargo to be chilled occupies only a portion of the container wherein the subject chilling unit is positioned.

Advantageously, the unit includes a sensor for sensing the temperature of the atmosphere surrounding any cargo in said container or, when present, under the insulating blanket. The unit preferably further includes a fan for drawing a sample of atmosphere and for directing it to said sensor. Advantageously, the fan is periodically operable.

In a particularly convenient arrangement, the outlet comprises a base portion of said insulated compartment and is positioned for directing chilled atmosphere into the void space between portions of a standard pallet upon which said unit is positionable.

Advantageously, the eutectic chilling elements are positioned in the unit substantially parallel with the flow of atmosphere from the inlet to the outlet and the unit further comprises an intake plenum chamber for receiving atmosphere from the inlet and having a plurality of outlet slots extending in a direction substantially parallel with the longitudinal axis of said eutectic elements and for orientating the flow of incoming atmosphere so as to promote the smooth flow of atmosphere over and around said eutectic elements.

In a particularly efficient arrangement, the unit further includes an outlet plenum chamber having a plurality of slotted inlets shaped and positioned for directing atmosphere received from a region containing said eutectic elements and for orientating the flow of said atmosphere into said outlet plenum in a manner which promotes smooth flow therethrough, said outlet plenum further including said outlet positioned at the bottom thereof.

Figure 1:
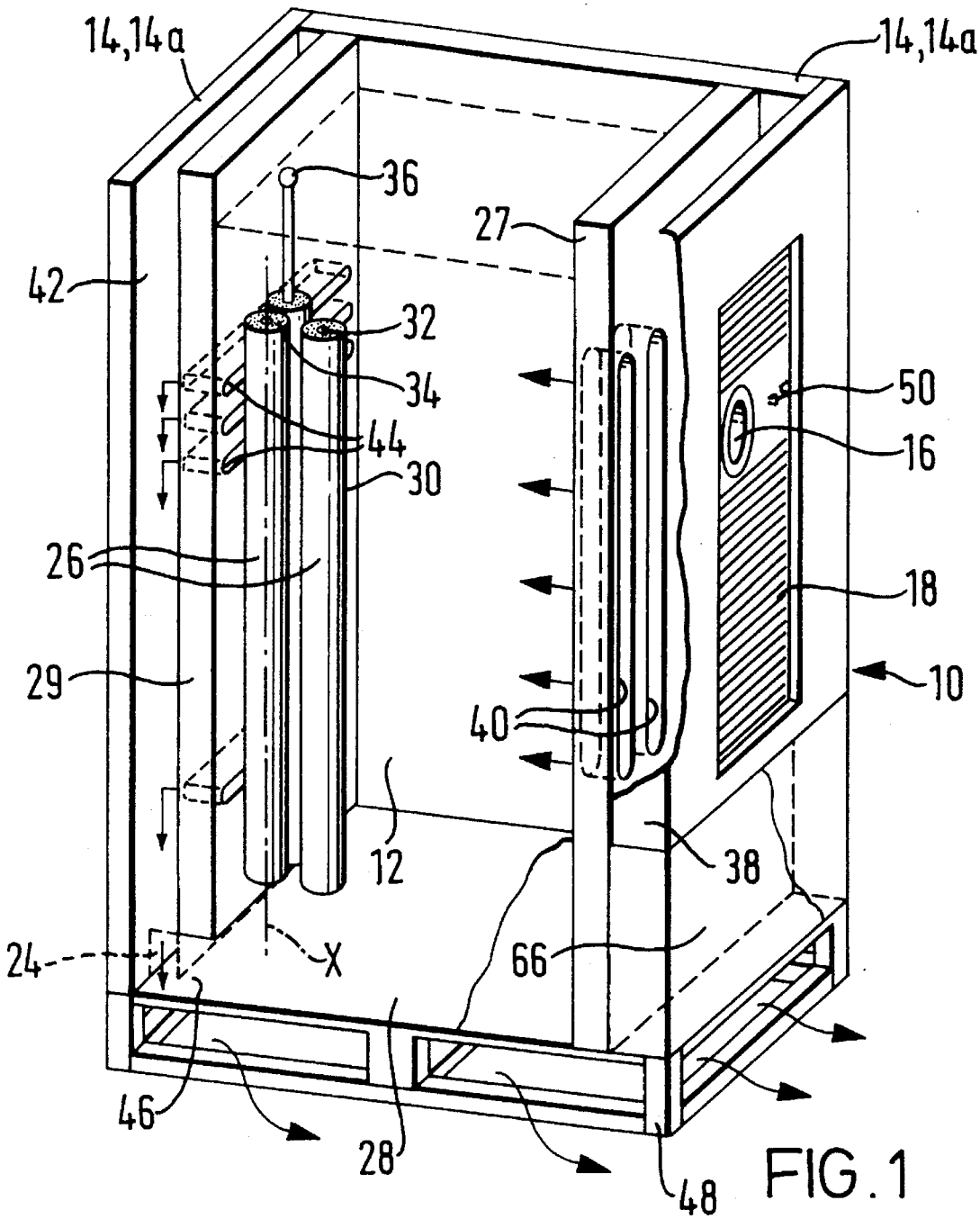
FIG. 1 is an isometric, partially exposed, view of a chilling unit according to the present invention.

Referring to FIG. 1, the chilling unit 10 comprises a compartment 12 having all outer walls 14 insulated by suitable insulating material 14*a*. An inlet 16 is provided in an insulated Tambour shutter 18 in a manner which allows the inlet to be moved vertically so as to alter its position as required. A fan (not shown) provides a means for drawing air or whatever atmosphere is contained within the container into which the chilling unit is placed into the chilling unit as and when required and for causing the chilled atmosphere to flow through the unit and out of an outlet 24.

A plurality of eutectic elements 26 each of which extends substantially parallel to the flow of atmosphere from inlet 16 to outlet 24 are provided in a central region 28 and further insulated from the inlet 16 and outlet 24 by inner walls 27, 29 each formed from material having a relatively high value of thermal insulation. Preferably, each eutectic element 26 comprises an outer tube 30 having a co-axial inner tube 32 passing therethrough along a longitudinal axis x and a mass of eutectic material 34 such as, for example, magnesium chloride filling the space there between. The inner tubes 32 are each connected to a supply coupling 36 through which liquid cryogen from a suitable source not shown is passed during a chilling step to be described in detail later herein. The eutectic elements 26 may be connected to each other, either in series or in parallel or in groups arranged in either series or in parallel, whichever best suits the particular arrangement.

An inlet plenum chamber 38 is formed between the wall having inlet 16 positioned therein and inner wall 27 which is provided with a plurality of slotted outlets 40 linking the plenum chamber 38 with the region containing the eutectic chilling elements 26. The slotted outlets 40 are each arranged to extend in a direction substantially parallel to the longitudinal axis x of the eutectic elements 26 so as to direct incoming atmosphere into central region 28 in a manner which promotes the smooth flow of said atmosphere over and around the eutectic elements 26. An outlet plenum chamber 42 is formed between inner wall 29 and a second outer wall 14. A plurality of slotted inlets 44 provided in inner wall 29 are shaped and positioned for directing atmosphere received from region 28 and for orientating the flow of said atmosphere into said outlet plenum in a manner which promotes smooth flow therethrough. Any atmosphere passing through the outlet plenum is directed downwardly towards outlet 24 positioned adjacent to or within the base 46 of said unit 10. Preferably, the outlet 46 is positioned for directing atmosphere into the void space between portions of a pallet 48 upon which said unit 10 is positionable. Alternatively, the outlet may be positioned for directing chilled air in any one of a number of preferred directions. Atmosphere exiting the unit 10 is free to pass through the open spaces in the pallet and flow towards the base of the cargo positioned with the container in which the unit 10 is positioned in a manner to be described in detail later herein.

Figure 2:
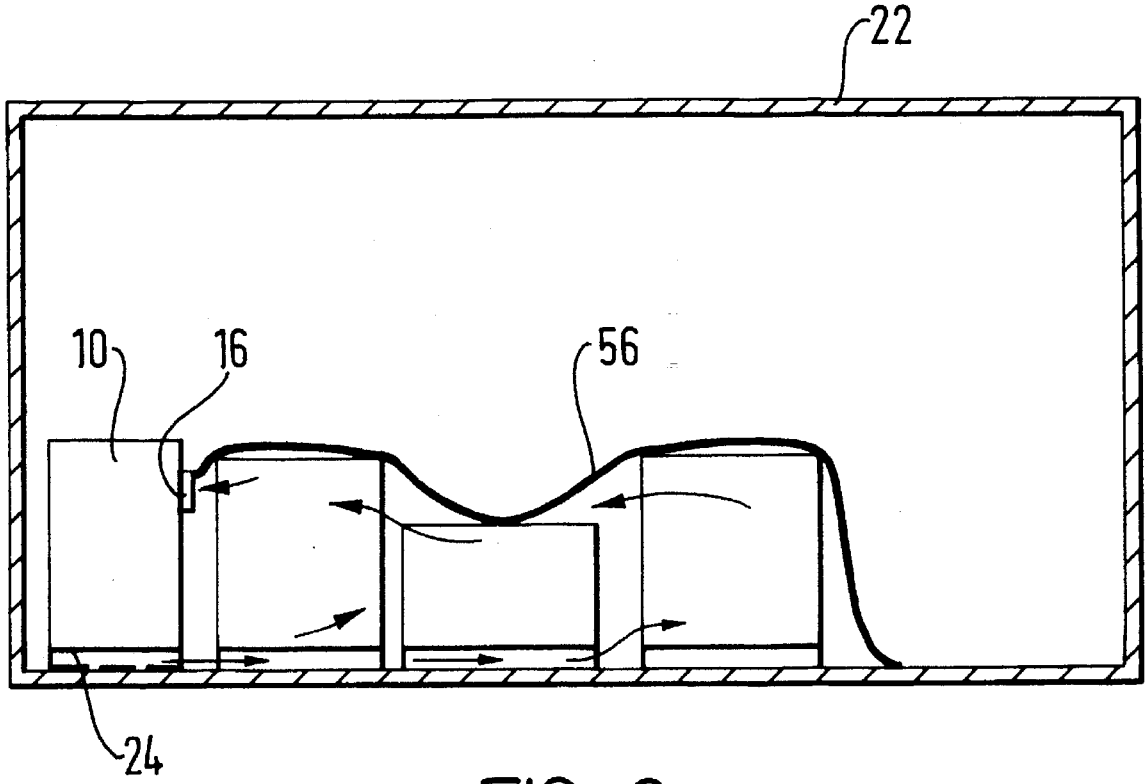
FIG. 2 is a general view of the unit shown in FIG. 1 when arranged in relationship within an insulating blanket forming part of the present invention and a cargo to be chilled.

As shown in FIG. 2, the chilling unit 10 is positioned within a container 22. The unit 10 may circulate air or atmosphere within container 22 by drawing it into inlet 16 and out of outlet 24, or may circulate air or atmosphere within insulating blanket 56 as will be described hereinafter.

Figure 4:
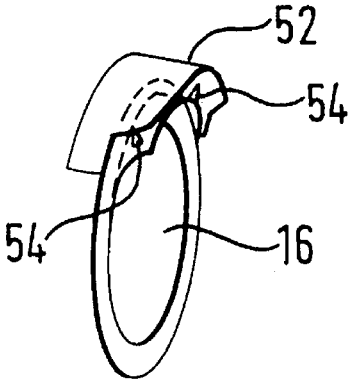
FIG. 3 is a cross sectional view of a sensor arrangement forming part of the present invention and FIG. 4 is an enlarged view of the inlet portion of the unit.

As shown in FIG. 4, the inlet 16 is provided with a securing means 50 in the form of, for example, a rubber keeper 52 and spikes 54 between which an edge of an insulating blanket 56 may be secured so as to ensure atmosphere is drawn from immediately thereunder. The insulating blanket 56 in FIG. 2, advantageously made from some form of closed cellular material such as that known as "bubble pack" and having a reflective surface provided thereon, is draped over any cargo in the container 22 so as to provide an insulating cover. Therefore, the operation of the chilling unit 10 is more efficient since it controls only the atmosphere underneath the insulating blanket 10.

Figure 3:
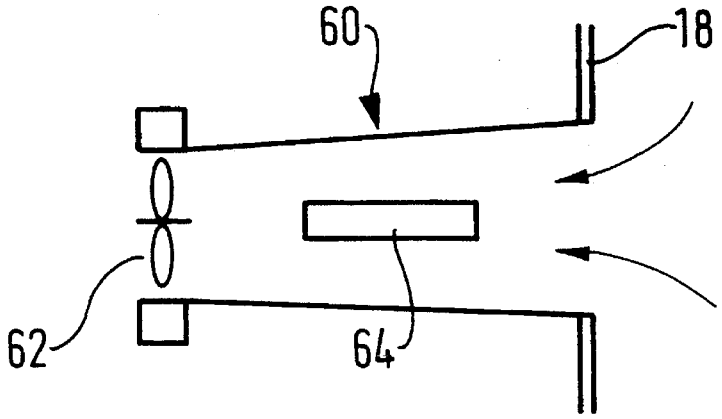

As illustrated in FIG. 3, a sampling device or "sniffer" 60 is employed to sample periodically the atmosphere to be temperature controlled by the chilling unit 10 and to initiate operation of a main fan as and when required. The "sniffer" 60 comprises a small, low power, electric fan 62 and a temperature sensor 64 positioned in the flow of any sampled atmosphere. The "sniffer" 60 further includes control means (not shown) for initiating operation of the main fan as and when required. Preferably, the "sniffer" 60 is positioned in the Tambour shutter 18 adjacent to the intake 16 so as to sample the warmest atmosphere under the blanket 56. A battery 66 in FIG. 1 is provided for powering fan 62 and the main fan.

In operation, the eutectic elements 26 are pre-chilled by allowing a quantity of cryogenic fluid, such as liquid nitrogen, to flow through inner tubes 32 so as to allow some of the chill contained therein to pass to the eutectic material 34. Once the eutectic material 34 is sufficiently chilled, surplus nitrogen is vented to atmosphere so that no liquid nitrogen remains in the tubes during subsequent operation of the unit. The highly insulated walls 14 effectively act to ensure that the eutectic elements 26 remain as cold as possible for as long as possible and ensure that their chilling effect is only utilized as and when required. After the unit 10 has been chilled, it may be placed in the container adjacent to the cargo to be subjected to temperature control. The insulating blanket 56 once draped over the selected cargo and secured to the inlet 16 effectively acts to define the boundary of the atmosphere to be chilled. Whenever the sensor, described later herein, detects that the temperature of the atmosphere under the blanket has risen above a predetermined value, it acts to initiate control over the main fan so as to draw atmosphere from the upper regions of the cargo and into plenum chamber 38 where it is orientated for flowing over the eutectic elements 26. Each eutectic element will act to chill the atmosphere passing thereover such that the atmosphere exiting unit 10 via outlet 24 will tend to be much cooler than that being drawn thereinto. The chilled atmosphere is directed back towards the cargo and tends to rise through the cargo as it surrenders its chilling capacity thereto. Clearly, if the cargo is all placed on pallets such as that upon which the unit 10 is positioned, then chilled atmosphere will be free to flow between the gaps in said pallets and act on the underside of the cargo as well as its sides.

It will be appreciated that one could use a number of the above units in one cargo container either to increase the cooling capacity or to create zones of differing temperatures, each protected by its own insulating blanket and each being suitable for a particular cargo. It will also be appreciated that by limiting the volume of atmosphere to be chilled to that under the insulating blankets, one will not be chilling the entire atmosphere within the container and hence it will be possible to increase significantly the effective operational life of such units. Additionally, the use of a temperature sensor and sampling device ensures that the unit is only used when chilling is actually required, thereby avoiding the possibility of over chilling the cargo.

I claim:

1. A portable chilling unit positionable within a container and for chilling the interior or a portion thereof, said unit comprising a thermally insulated compartment having a chilling means positioned therein and having an inlet for receiving atmosphere into the compartment from the interior of the container, an insulating blanket for placement over any cargo positioned within said container, said inlet being positioned immediately under said blanket, drawing means for drawing atmosphere into the compartment from under said blanket and expelling said atmosphere from the compartment through an outlet positioned below said inlet, said chilling means comprising a plurality of eutectic elements and means for pre-chilling said elements by exposure to the chilling effect of liquid cryogen.

2. A chilling unit in accordance with claim 1 including a sensor for sensing the temperature of the atmosphere surrounding any cargo under said blanket.

3. A chilling unit in accordance with claim 2 further including a fan positioned such that, in operation, it will withdraw a sample of the atmosphere under said blanket and direct said sample to said sensor, and control means to operate said fan.

4. A chilling unit in accordance with claim 3 wherein said control means further comprises means to operate said fan periodically.

5. A chilling unit in accordance with claim 1 further including securing means for securing an edge of said blanket to said inlet such that said unit chills only the atmosphere under said blanket.

6. A chilling unit in accordance with claim 1 further including means to adjust the height of said inlet.

7. A chilling unit in accordance with claim 1 where said outlet comprises a base portion of said insulated compartment and is positioned such that, when said chilling unit is positioned on a pallet, chilled atmosphere is directed from said outlet into the void space between portions of said pallet.

8. A chilling unit in accordance with claim 1 wherein said eutectic elements are positioned substantially parallel to the flow of atmosphere from the inlet to the outlet and the unit further comprises an intake plenum chamber for receiving atmosphere from the inlet and having a plurality of outlet slots extending in a direction substantially parallel to the longitudinal axis of said eutectic elements and for orientating the flow of incoming atmosphere so as to promote the smooth flow of atmosphere over and around said eutectic elements.

9. A chilling unit in accordance with claim 1 further including an outlet plenum chamber having a plurality of slotted inlets shaped and positioned for directing atmosphere received from a region containing said eutectic elements and for orientating the flow of said atmosphere into said outlet plenum in a manner which promotes smooth flow therethrough, said outlet plenum further including said outlet positioned at the bottom thereof.

* * * * *